US011067338B2

(12) United States Patent
Habib et al.

(10) Patent No.: US 11,067,338 B2
(45) Date of Patent: Jul. 20, 2021

(54) AIR COOLED CONDENSER (ACC) WIND MITIGATION SYSTEM

(71) Applicant: The Babcock & Wilcox Company, Barberton, OH (US)

(72) Inventors: Tony F Habib, Lancaster, OH (US); Mitchell W Hopkins, Uniontown, OH (US)

(73) Assignee: The Babcock & Wilcox Company, Akron, OH (US)

( * ) Notice: Subject to any disclaimer, the term of this patent is extended or adjusted under 35 U.S.C. 154(b) by 139 days.

(21) Appl. No.: 16/116,272

(22) Filed: Aug. 29, 2018

(65) Prior Publication Data

US 2019/0072333 A1 Mar. 7, 2019

Related U.S. Application Data

(60) Provisional application No. 62/553,508, filed on Sep. 1, 2017.

(51) Int. Cl.

| | |
|---|---|
| ***F28B 1/06*** | (2006.01) |
| ***F28B 11/00*** | (2006.01) |
| ***F28F 27/00*** | (2006.01) |
| ***F28F 9/02*** | (2006.01) |
| ***F28B 9/00*** | (2006.01) |
| ***F28F 13/12*** | (2006.01) |

(52) U.S. Cl.

CPC ..... *F28B 1/06* (2013.01); *F28B 9/00* (2013.01); *F28B 11/00* (2013.01); *F28F 9/0268* (2013.01); *F28F 13/12* (2013.01); *F28F 27/00* (2013.01); *F28F 2250/08* (2013.01)

(58) Field of Classification Search

CPC ..... F28B 1/06; F28B 9/00; F28B 11/00; F28F 9/0268; F28F 13/12; F28F 27/00; F28F 2250/08

See application file for complete search history.

(56) References Cited

U.S. PATENT DOCUMENTS

| | | | | |
|---|---|---|---|---|
| 2,258,731 | A * | 10/1941 | Blumenthal | F21V 33/0096 415/121.3 |
| 4,217,317 | A * | 8/1980 | Neu | F28B 1/06 261/160 |
| 7,400,057 | B2 * | 7/2008 | Sureshan | F03D 1/04 290/55 |
| 7,431,270 | B2 * | 10/2008 | Mockry | B01B 1/005 261/28 |
| 8,302,670 | B2 * | 11/2012 | Yang | F28F 13/06 165/67 |
| 8,776,545 | B2 * | 7/2014 | Blockerye | F28B 1/06 62/455 |
| 2009/0220334 | A1 * | 9/2009 | Vouche | F04D 29/526 415/119 |
| 2015/0096736 | A1 * | 4/2015 | Bronicki | F24F 1/48 165/288 |

(Continued)

*Primary Examiner* — Jon T. Schermerhorn, Jr.
(74) *Attorney, Agent, or Firm* — Michael J. Seymour

(57) ABSTRACT

The present disclosure relations to wind mitigation devices which include a deflector that having an inlet and an outlet. An axial fan is disposed above the outlet of the deflector and includes a shroud. The shroud of the axial fan and the outlet of the deflector are aligned along a common vertical axis. The deflector is adapted to receive an airflow at the inlet and direct the airflow through the outlet in a vertical direction toward the axial fan.

19 Claims, 8 Drawing Sheets

(56) References Cited

U.S. PATENT DOCUMENTS

| | | | | |
|---|---|---|---|---|
| 2016/0040937 | A1* | 2/2016 | Guerdon | F04D 29/541<br>62/455 |
| 2016/0084227 | A1* | 3/2016 | Krippene | F03D 3/0427<br>290/55 |

* cited by examiner

AIR COOLED CONDENSER (ACC) WIND MITIGATION SYSTEM

BACKGROUND

The present disclosure relates in general to devices, systems, and methods that mitigate the effect of wind on air cooled condensers. More particularly, the present disclosure is directed to deflector devices which are adapted to receive an airflow at an inlet and direct the airflow through an outlet in a vertical direction toward an axial fan, and will be described with reference thereto. However, it is appreciated that the present exemplary embodiment is also amenable to other like applications.

Air cooled condenser (ACC) systems are becoming more common for cooling steam from turbine exhaust, especially in areas where water is not readily available. These devices typically use axial fans to blow air vertically and against a heat exchanger, which removes heat from steam exiting a turbine and causes the steam to condense. As a result, back pressure is lowered within the system. The heat exchanger can be arranged in any configuration known in the art, such as an inverted V-frame, V-frame, or a-frame configurations. Steam flows into the heat exchanger from an upper header downward to a lower header which collects condensate. The axial fan is designed to deliver airflow required to remove the heat from the steam such that the turbine exit pressure meets design limitations. If the air supplied by the axial fan does not provide sufficient cooling, the turbine exit pressure will consequently increase, resulting in a reduction in power generation.

ACC systems are sensitive to wind as it impacts the fan axial flow. For example, in high wind conditions, air or wind typically approaches the fan at a horizontal trajectory, making it difficult to direct the air 90° such that it flows into the fan intake. This difficulty in directing the airflow results in a rise in static pressure, which in turn reduces the fan flow capacity. Consequently, the lower airflow reduces the thermal performance of the fan and results in an increased turbine back pressure. Prior solutions to mitigating these performance issues have included raising the fan power to compensate for flow deficiency. However, raising the fan power is not a desired mitigation scheme as it increases parasitic loss, thus reducing plant thermal efficiency. Other prior solutions have included placing flow aid devices adjacent to the ACC to help mitigate the wind effect, such as wind screens or the guides described in U.S. Patent Application Publication No. 2009/0165993, titled AIR GUIDE FOR AIR COOLED CONDENSER).

However, in certain ACC applications, systems with lower than typical fan power consumption are desired. In such cases, the vertical air velocity provided by the axial fan is relatively lower than other high powered fans, and the wind has greater impact on fan performance. However, prior conventional solutions have not been able to sufficiently mitigate the deleterious wind effect.

It is thus an object of the present disclosure to provide a wind mitigation device that is capable of mitigating the deleterious wind effect without increasing the power load on the axial fan.

BRIEF DESCRIPTION

The present disclosure relates to wind mitigation devices that generally include a deflector having an inlet and an outlet. An axial fan is disposed above the outlet of the deflector and includes a shroud. The shroud of the axial fan and the outlet of the deflector are aligned along a common vertical axis. The deflector is adapted to receive an airflow at the inlet and direct the airflow through the outlet in a vertical direction toward the axial fan. The outlet of the deflector is positioned generally adjacent to a bottom portion of the shroud. The shroud has a diameter greater than a diameter of the deflector outlet.

In some embodiments, the deflector inlet is aligned along an axis different from the axis of the shroud and the deflector outlet. The deflector can have an elbow shape such that the deflector inlet is aligned along a horizontal axis perpendicular to the common vertical axis of the shroud and the deflector outlet. A diameter of the deflector inlet and the deflector outlet can be identical. In some particular embodiments, the diameter is about 3 m to about 10 m. In other embodiments, the deflector further includes an inner surface having one or more vanes positioned along the inner surface.

In other embodiments, the deflector further includes a scoop section connected to a vertical pipe section. The inlet of the deflector is located at an open front wall of the scoop section and the outlet of the deflector is located on the vertical pipe section. The scoop section comprises a bottom wall and a back wall configured to direct the airflow into the vertical pipe section.

In particular embodiments, the bottom wall is aligned with a horizontal axis and the back wall extends at an angle of about 45 degrees to about 75 degrees with respect to the horizontal axis, including about 60 degrees. In other particular embodiments, the bottom wall is aligned with an axis extending at an angle of about −5 degrees to about −35 degrees with respect to the horizontal axis, including about −20 degrees. The back wall can have a length of about 5 m to about 10 m.

In some embodiments, the wind mitigation device further includes a mechanism configured to rotate the deflector such that the deflector inlet is aligned with a direction of the airflow.

Also disclosed in embodiments herein is a wind mitigation device including a plurality of deflectors arranged in an array and a plurality of axial fans and shrouds disposed above the plurality of deflectors. In particular embodiments, the plurality of deflectors are arranged along an outer perimeter of the array. In other particular embodiments, each one of the plurality of deflectors are staggered with respect to another one of the plurality of deflectors in the array such that the inlets of the plurality of deflectors are located at varying heights.

The present disclosure also relates to air-cooled condensing systems including the exemplary wind mitigation devices of the present disclosure. According to embodiments, the air-cooled condensing system includes a plurality of deflectors each including an inlet and an outlet. A plurality of axial fans are disposed above the outlets of the deflectors and each include a shroud, the shrouds of the axial fans and the outlets of the deflectors each being aligned along a common vertical axis, the deflectors each configured to receive an airflow at the inlets and direct the airflow through the outlets in a vertical direction toward the axial fans. A platform supports the axial fans and shrouds and optionally supports the plurality of deflectors. A heat exchanger is disposed above the platform to receive the airflow from the axial fans.

The present disclosure also relates to methods for mitigating wind in an air-cooled condensing system. The method includes providing a plurality of deflectors each including an inlet and an outlet; disposing the outlets of the plurality of deflectors under a plurality of axial fans and shrouds such that the shrouds and the outlets of the deflectors are aligned along a common vertical axis; receiving an airflow at the inlets of the plurality of deflectors; and directing the airflow through the outlets in a vertical direction toward the axial fans.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
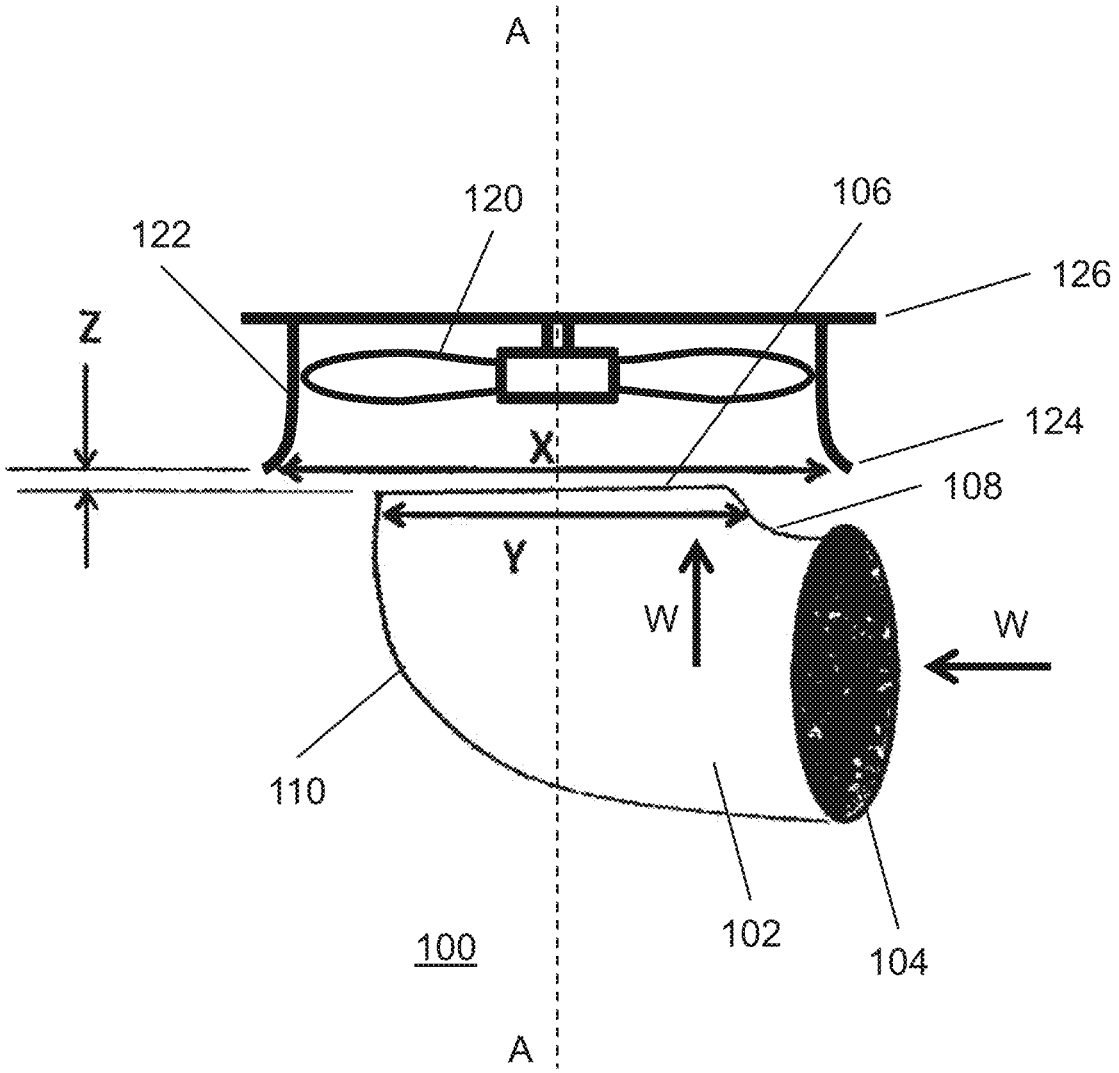
FIG. 1 is a side view of a first embodiment of the present disclosure showing a wind mitigation device which includes an elbow shaped deflector.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of."

Numerical values should be understood to include numerical values which are the same when reduced to the same number of significant figures and numerical values which differ from the stated value by less than the experimental error of conventional measurement technique of the type described in the present application to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

It should be noted that many of the terms used herein are relative terms. For example, the terms "upper" and "lower" are relative to each other in location, i.e. an upper component is located at a higher elevation than a lower component in a given orientation. The terms "inlet" and "outlet" are relative to a fluid flowing through them with respect to a given structure, e.g. a fluid flows through the inlet into the structure and flows through the outlet out of the structure.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" and "bottom" or "base" are used to refer to surfaces where the top is always higher than the bottom/base relative to an absolute reference, i.e. the surface of the earth. The terms "above" and "below" are used to refer to the location of two structures relative to an absolute reference. For example, when the first component is located above a second component, this means the first component will always be higher than the second component relative to the surface of the earth. The terms "upwards" and "downwards" are also relative to an absolute reference; an upwards flow is always against the gravity of the earth.

The present disclosure relates to deflector devices, such as elbows or air scoops that channel wind into axial fans. The deflectors turn the incoming airflow in the vertical direction, thereby providing required coolant air to heat exchanges located above the deflectors and axial fans. The deflector devices disclosed herein eliminate the stagnation zone at the fan inlet at high wind conditions, thereby reducing the static pressure at the fan inlet. As such, the size and the placement of the deflectors relative to the fan shroud is critical in terms of minimizing the wind effect at high wind velocity, but at the same time maintain axial fan performance at zero wind condition.

The deflector devices can be stationary or can be rotated such that their inlets are aligned with the flow of the wind. The devices can be made of any suitable material providing structural stability.

Referring to FIG. 1, an exemplary wind mitigation device 100 is illustrated. The wind mitigation device 100 includes a deflector 102 having an inlet 104 and an outlet 106. The deflector 102 is configured as a pipe having a general elbow shape defined by curved surfaces 108 and 110. The curved surfaces 108, 110 aid in delivering an even airflow through the deflector 102. Similarly, the deflector 102 can include one or more vanes (not shown) positioned along an inner surface of the deflector to further aid in delivering even airflow. An axial fan 120 is disposed above the outlet 106 of the deflector 102 and includes a shroud 122 surrounding the axial fan. The fan shroud 122 may have a cylindrical inner wall surrounding the fan, or may have some degree of a tapered profile as is known in the art. The fan shroud 122 has a bottom portion 124 and an upper portion 126, with the outlet 106 of the deflector 102 being positioned generally adjacent to the bottom portion of the shroud at a distance Z. The shroud, axial fan, and the outlet of the deflector are aligned along a common vertical axis A.

The deflector 102 is adapted to receive an airflow W at the inlet 104 and direct the airflow through the body of the deflector and out of the outlet 106 in a vertical direction toward the axial fan 120 and shroud 122. In this regard, the deflector inlet 104 is aligned along an axis different from the vertical axis of the axial fan 120, shroud 122, and deflector outlet 106. As shown in FIG. 1, the deflector inlet 104 is generally aligned along a horizontal axis that is perpendicular to the common vertical axis of the axial fan 120, shroud 122, and deflector outlet 106. Moreover, in some embodiments, the deflector inlet 102 and outlet 104 may have a substantially identical diameter. The identical diameter of the inlet and outlet may be from about 3 m to about 10 m. In particular embodiments, the diameter is from about 5 m to about 9 m. A larger diameter inlet and outlet is generally desirable when the wind mitigation device 100 is exposed to higher wind speeds and allows for improved air collection performance when the deflector inlet 104 is aligned with the wind airflow. A smaller diameter inlet and outlet is generally desirable when the wind mitigation device 100 is exposed to lower wind speeds, however a smaller diameter may result in less air collection reduction when the deflector inlet 104 is not exactly aligned with the wind airflow.

The present disclosure is not necessarily limited to the configurations described above, and other configurations are contemplated without deviating from the scope of the present disclosure. For example, the deflector inlet 104 may be aligned along any desired axis, as long as the deflector outlet 106 directs the airflow vertically toward the axial fan 120. Additionally, the deflector inlet 104 and outlet 106 may have different diameters. However, the diameter Y of the outlet 106 should generally be less than the diameter X of the shroud 122.

Figure 2:
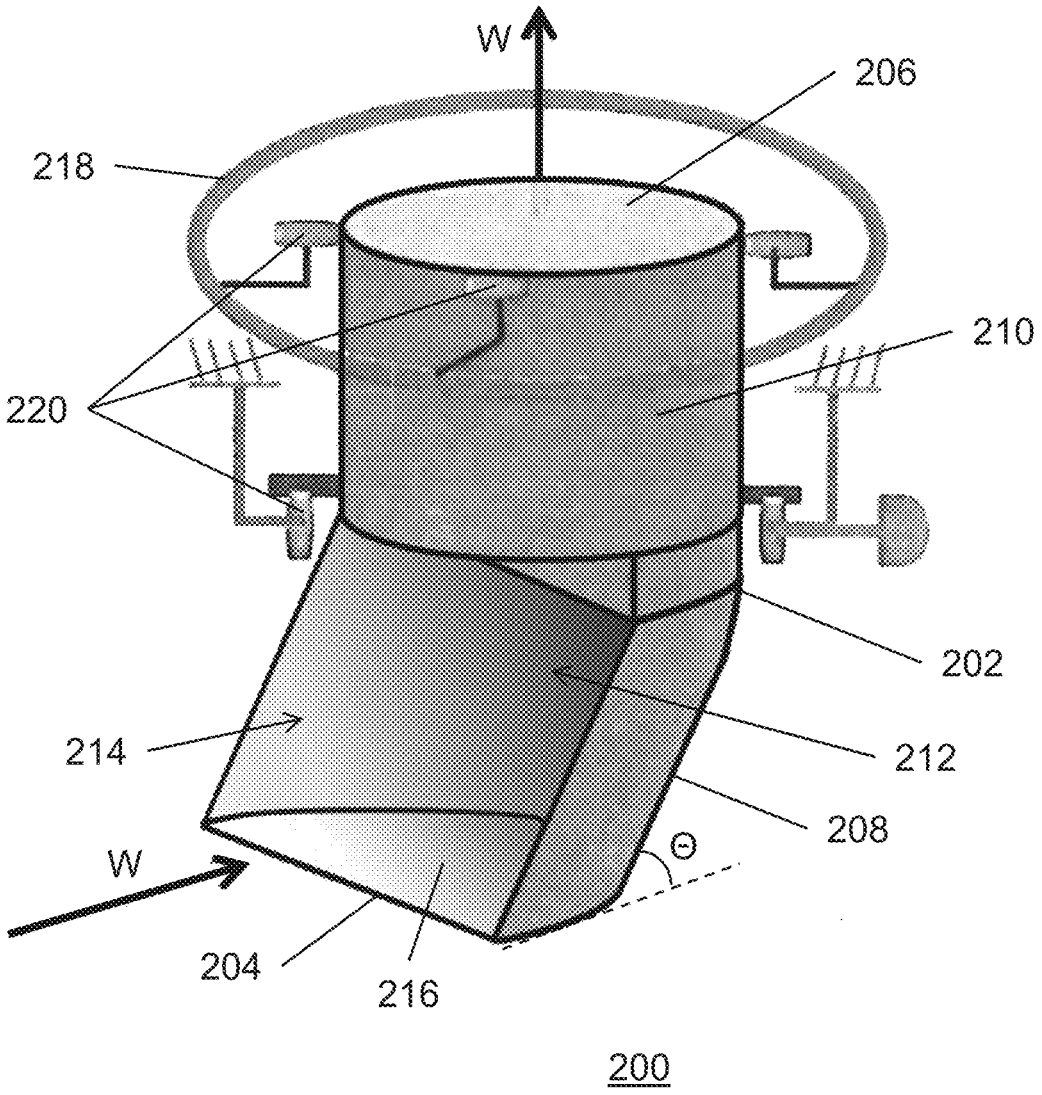
FIG. 2 is a perspective view of a second embodiment of the present disclosure showing a wind mitigation device which includes a scoop-type deflector.

Referring now to FIG. 2, a second embodiment of a wind mitigation device 200 is illustrated. The wind mitigation device 200 includes a deflector 202 having an inlet 204 and an outlet 206. The deflector 202 is generally configured with two main components, including a scoop section 208 connected to a vertical pipe section 210. The deflector inlet 204 is located at an open front wall 214 of the scoop section 208 and the deflector outlet 206 is located at an upper portion of the vertical pipe section 210. The scoop section 208 further includes a bottom wall 216 and a back wall 212 configured to direct the airflow W into the vertical pipe section 210. The bottom wall 216 of the scoop section 208 is illustrated as being aligned with a horizontal axis that is generally parallel to a normal X-axis. In other embodiments, the bottom wall 216 of the scoop section 208 can be aligned with an axis that extends at an angle of about −5 degrees to about −35 degrees with respect to the normal horizontal X-axis. In some particular embodiments, the bottom wall 216 can be aligned with an axis that extends at an angle of about −20 degrees with respect to the normal X-axis.

The back wall 212 of the scoop section 208 extends away from the bottom wall 216 at a positive angle Θ with respect to the horizontal axis of the bottom wall. In some embodiments, the angle Θ of the back wall is about 45 degrees to about 75 degrees. In some particular embodiments, the angle Θ of the back wall is about 60 degrees. The back wall can be flat or curved and can have a length of about 5 m to about 10 m. In particular embodiments, the back wall has a length of about 8 m to about 9.5 m.

The scoop section 208 and the vertical pipe section 210 of the deflector 202 may include one or more vanes (not shown) positioned along inner surfaces thereof of to aid in delivering an even airflow. While not illustrated in FIG. 2, the deflector 202 is configured similarly to deflector 102 of FIG. 1 with respect to the axial fan 120 and shroud 122. That is, the axial fan 120 and shroud 122 would be disposed above the outlet 206 of the deflector 202, and the outlet 206 of the deflector 202 would be positioned generally adjacent to the bottom portion of the shroud at a distance Z. Moreover, deflector outlet 206 would be aligned along a common vertical axis shared by the axial fan 120 and shroud 122.

The deflector 202 is adapted to receive an airflow W at the inlet 204 of the open front wall 214 and direct the airflow through scoop 208, to the vertical pipe portion 210, and out of the outlet 206 in a vertical direction toward the axial fan. In this regard, similar to deflector 102, the deflector inlet 204 is aligned along an axis different from the vertical axis of the deflector outlet 206. In some embodiments, the vertical pipe portion 210 is a constant cylinder having a diameter of about 3 m to about 10 m, including from about 7 m to about 9 m. Moreover, similar to deflector 102 illustrated in FIG. 1, the diameter of the deflector outlet 206 should generally be less than the diameter X of the shroud 122.

The wind mitigation device 200 of FIG. 2 further illustrates a rotation mechanism 218 used to rotate the deflector 202. The rotation mechanism 218 includes one or more powered rollers 220 which generally act on the vertical pipe portion 210 and enable the rotation of the entire deflector 202. Rotation may be desired, for example, to accommodate changes in wind behavior such that the inlet 206 can be aligned or misaligned with the direction of the airflow of the wind. In this regard, the cooling effect of the airflow being directed onto a heat exchanger located above the deflector 202 and axial fan can be maintained or varied as desired. Moreover, while the deflector 102 of FIG. 1 illustrates a stationary embodiment of the wind mitigation devices described in the present disclosure, it should be understood that deflector 102 could similarly include a rotation mechanism similar to the rotation mechanism 218 of deflector 202.

The elbow shaped deflector 102 of FIG. 1 and the scoop deflector 202 of FIG. 2 operate in a similar manner, however one design may be desired over the other depending on the design constraints of the associated ACC system in which the deflectors are being used. For example, the elbow deflector 102 may result in better air collection when aligned with the direction of airflow of the wind and performance can be improved with internal vanes. However, the elbow deflector 102 may be more expensive to build and install. The scoop deflector 202 is less dependent on direction of the airflow of the wind and results in better air collection when the deflector inlet 204 is not exactly aligned with the wind direction. Moreover, the scoop deflector 202 is generally less expensive to build and install.

Figure 3A:
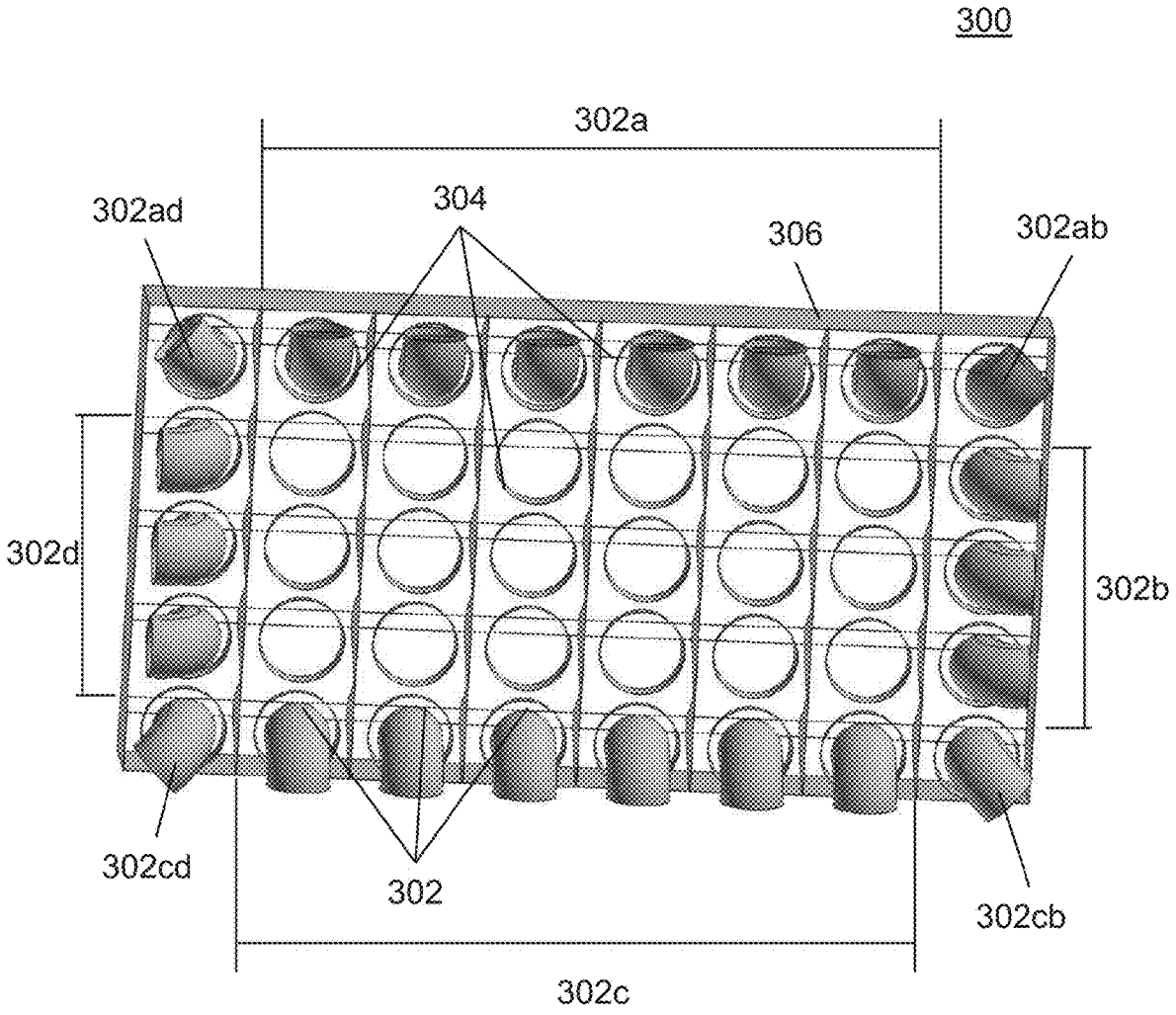
FIG. 3A is a perspective bottom view of a first array of deflectors making up a wind mitigation device according to embodiments of the present disclosure.
Figure 3B:
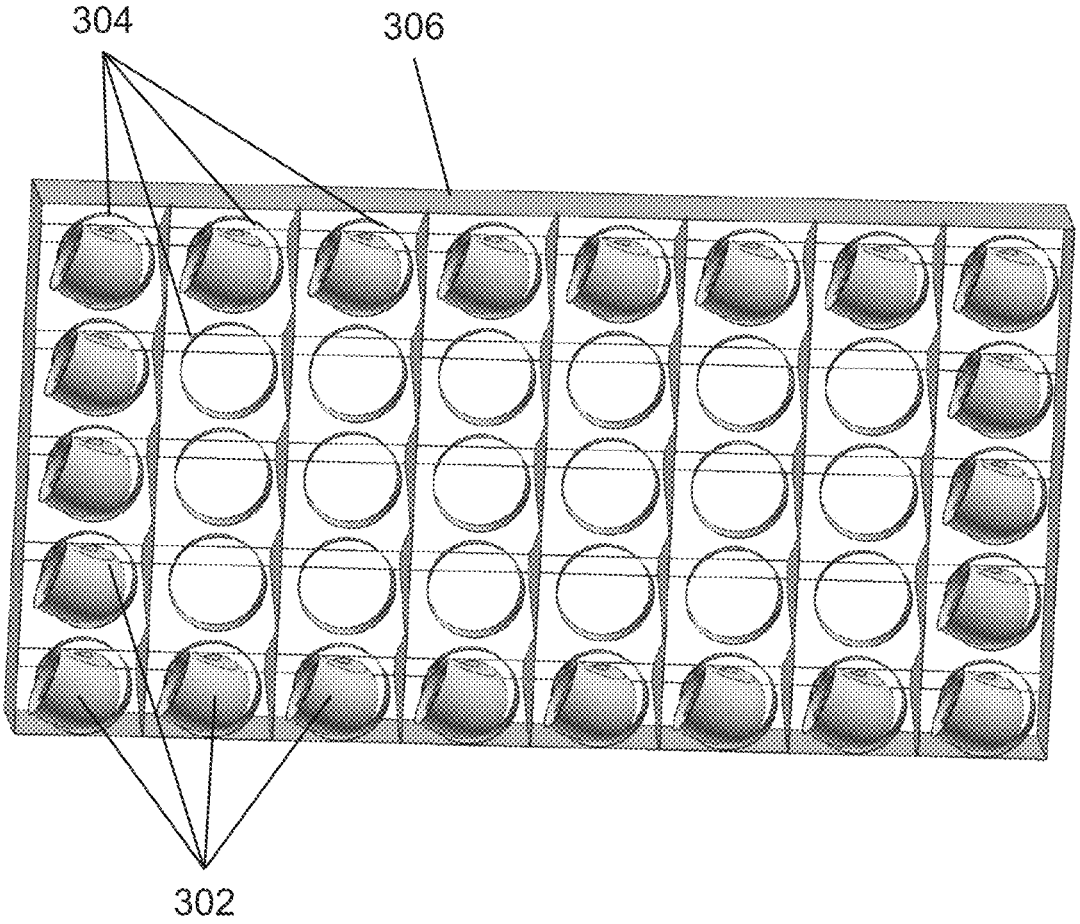
FIG. 3B is a perspective bottom view of the array in FIG. 3A showing the all of the deflectors rotated to a similar angle in accordance with embodiments of the present disclosure.
Figure 3C:
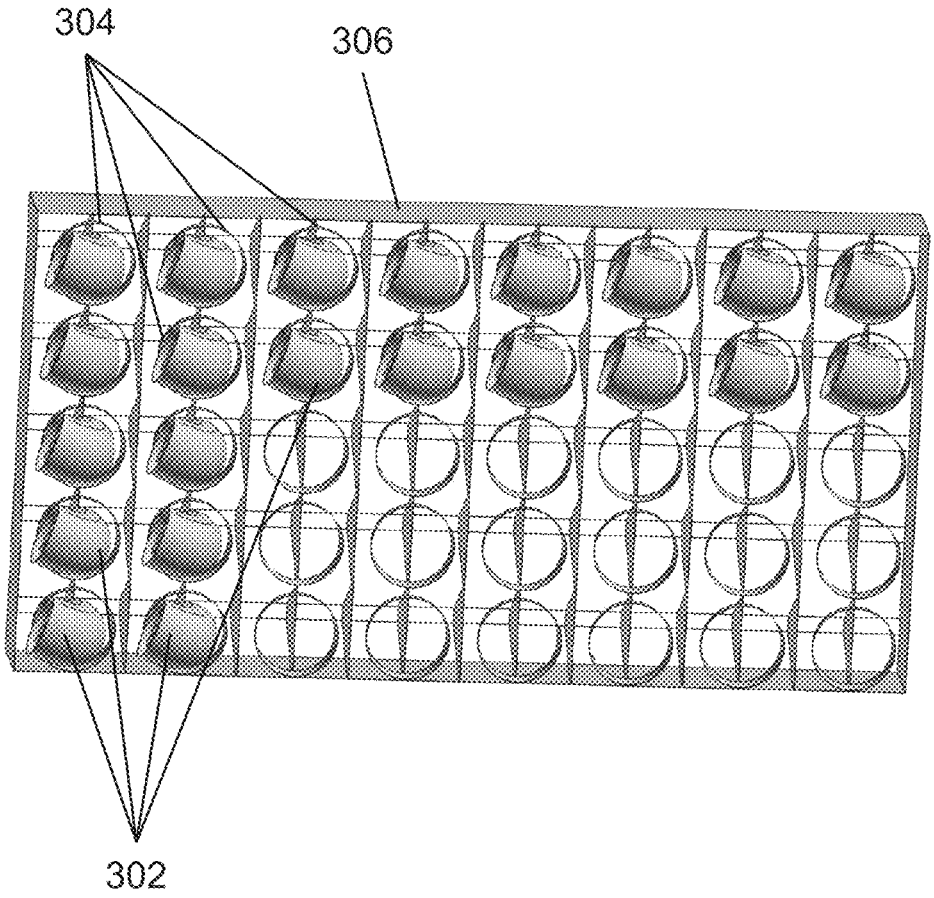
FIG. 3C is a perspective bottom view of a second array of deflectors making up a wind mitigation device according to embodiments of the present disclosure.

Turning now to FIGS. 3A-3C, a wind mitigation device 300 is illustrated which includes a plurality of deflectors 302 arranged in various arrays. A plurality of axial fans (not shown) and a plurality of shrouds 304 are also shown as being disposed above the plurality of deflectors. Each of the plurality of deflectors 302 operate in substantially the same manner as deflector 102 described above with respect to FIG. 1. Moreover, while the plurality of deflectors 302 are illustrated as having the elbow shape of deflector 102, it should be understood that the scoop deflectors 202 described above with respect to FIG. 2 could similarly be arranged as a plurality and in the arrays shown in FIGS. 3A-3C.

FIGS. 3A-3C also illustrate a fan deck 306 which is a support structure that typically supports the plurality of axial fans and the plurality of shrouds 304. The plurality of deflectors 302 may also be supported by the fan deck 306, however the present disclosure is not necessarily limited thereto. For example, the plurality of deflectors 302 may include their own support structure which may support the plurality of deflectors in any desired configuration, such as from the bottoms or the sides of the deflectors.

The arrays shown in FIGS. 3A-3C are illustrated as being configured to accommodate a fan deck 306 capable of supporting 40 axial fans and associated shrouds. However, the arrays can be configured to accommodate any number of desired fans and associated shrouds desired for a particular ACC system. In addition, the arrays in FIGS. 3A-3C are illustrated as including 22 axial fans and shrouds that include deflectors 302 and 18 axial fans and shrouds that do not include deflectors. It should be understood that the particular number of deflectors is only exemplary, and any number of deflectors can be included as desired for a particular ACC system. Moreover, the plurality of deflectors 302 in the arrays of FIG. 3A-3C are all illustrated as being located approximately the same distance from their associated plurality of shrouds 304. However, it is contemplated that each one of the plurality of deflectors could be staggered with respect to another one of the plurality of deflectors in the array. In such a configuration, the inlets of the plurality of deflectors would be located at varying heights in order to maximize wind airflow collection.

Referring specifically to FIG. 3A, the plurality of deflectors 302 are arranged around an outer perimeter of the array only. The four general rows of deflectors 302*a*, 302*b*, 302*c*, and 302*d* all have inlets which generally face the cardinal directions of N, E, S, and W, respectively. The four corner deflectors 302*ab*, 302*cb*, 302*cd*, and 302*ad* all have inlets which generally face the ordinal directions of NE, SE, SW, and NW, respectively. The array arrangement and directional inlet positions of the plurality of deflectors 302 in FIG. 3A may be desired in conditions where the wind is supplying airflow from multiple directions.

Referring now to FIG. 3B, the plurality of deflectors 302 are arranged around an outer perimeter of the array only, similar to FIG. 3A. However, each of the plurality of deflectors 302 have their inlets facing in the same general direction. In particular, each deflector in the plurality of deflectors 302 are facing in a slightly north-western direction. Turning now to FIG. 3C, the plurality of deflectors 302 are arranged in the array as a general "L-shape." Each of the plurality of deflectors 302 in FIGS. 3B and 3C have their inlets facing in the same general direction, i.e. a slightly north-western direction. The array arrangement and directional inlet positions of the plurality of deflectors 302 in FIGS. 3B and 3C may be desired when wind conditions supply airflow from a generally single direction (e.g., from the north-west).

The array arrangements shown in FIGS. 3A and 3B, where the plurality of deflectors 302 are arranged around an outer perimeter of the array only, has been found to achieve the best efficiency on performance of the ACC system. However, if a larger impact on ACC performance is required, it may be desired to include deflector for every axial fan and shroud in the array. Alternatively, deflectors may be placed on only the worst performing axial fans and still improve ACC performance.

Figure 4:
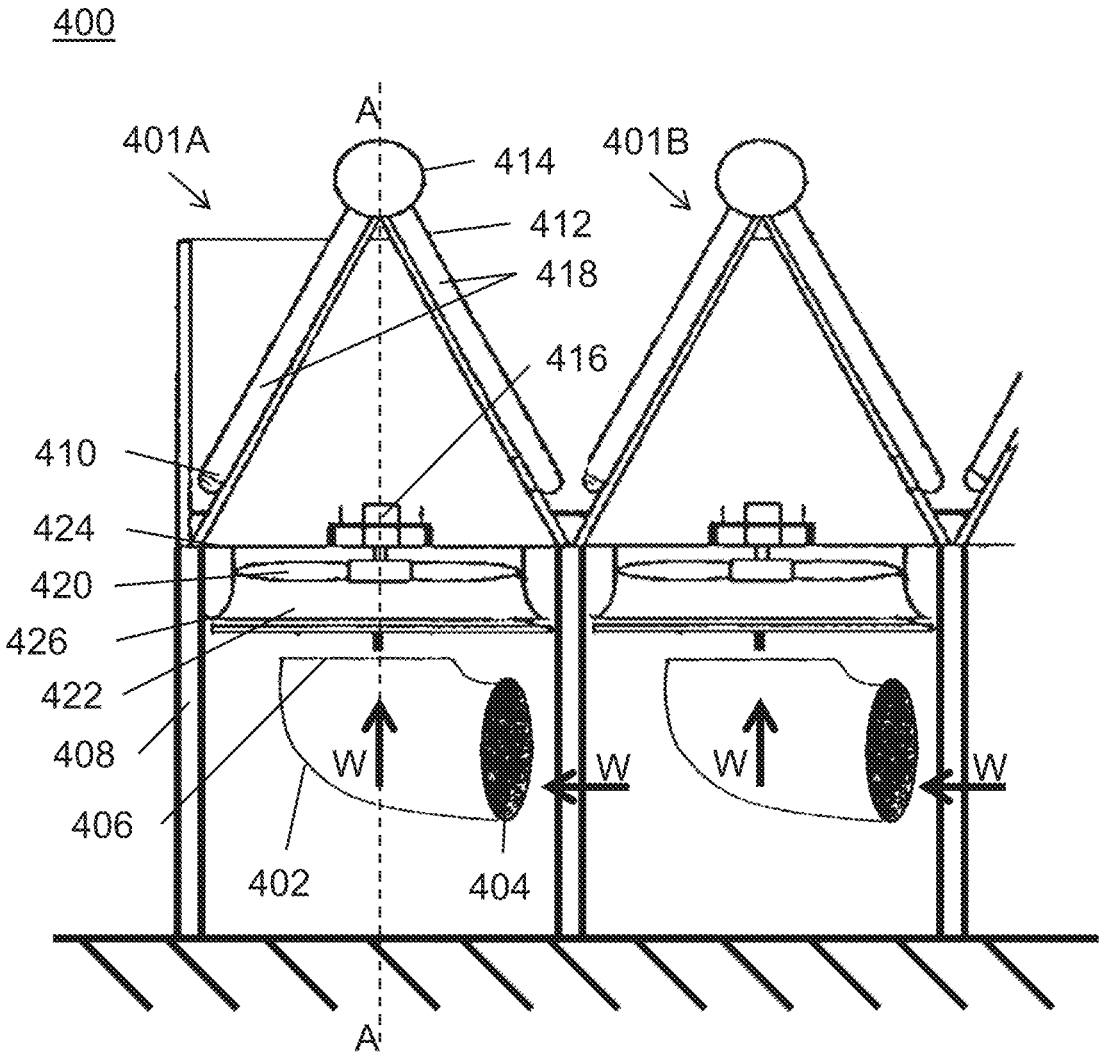
FIG. 4 is a side view of an air-cooled condensing (ACC) system which includes a wind mitigation device according to embodiments of the present disclosure.

FIG. 4 illustrates an air cooled condensing (ACC) system 400 that includes a first ACC unit 401A and a second ACC unit 401B. Only two ACC units are illustrated for clarity of illustration. However, it should be understood that the ACC system 400 generally includes multiple ACC units within the system, wherein a plurality of deflectors, axial fans, and shrouds are arranged in an array, such as the arrays described above and illustrated in FIGS. 3A-3C. In addition, only the component parts of the first ACC unit 401A have been labeled in FIG. 4 for clarity of illustration. However, the second ACC unit 402B should be understood to include the same component parts as the first ACC unit 401A.

The ACC system 400 in FIG. 4 is generally supported by a platform support 408 and each unit within the ACC system, including units 401A and 401B, have a deflector 402, an axial fan 420, and an associated shroud 422. The deflector 402 illustrated in FIG. 4 is similar to the elbow shaped deflector 102 in FIG. 1. However, the deflector 202 of FIG. 2 could similarly be used. Each of the plurality of deflectors 402 in the ACC system 400 include an inlet 404 and an outlet 406. A plurality of axial fans 420 are disposed above the outlets 406 of the deflectors 402 and each include a motor 416 and an associated shroud 422. The shrouds 422 of the axial fans 420 and the outlets 406 of the deflectors 402 are each aligned along a common vertical axis A. The deflectors 402 are each configured to receive an airflow W at the inlets 404 and direct the airflow through the outlets 406 in a vertical direction toward the axial fans 420, as described above with respect to deflectors 102 and 202.

The axial fans 420 in the ACC system 400 blow the deflected air W upward and past a heat exchanger structure 412. The heat exchanger structure 412 is illustrated as having an inverted V-frame configuration, however other configurations may also be used, such as V-frame configurations or a-frame configurations. The heat exchanger 412 comprises a series of angled condenser tube coil structures 418 which receive steam generated from a turbine (not shown). The condenser tube coil structures 418 are elongated coils that together form a planar-sheet like structure through which air can pass and receive steam from an upper steam duct/header 414. The steam received in the condenser tube coil structures 418 is cooled by heat exchange with the air blown upward from axial fan 420, thereby causing the steam to condense and be collected in a lower condensate duct/header 410. By condensing the steam via heat exchange, the turbine exit pressure is lowered, thereby preventing a reduction in power generation.

The plurality of deflectors 402 aid in this heat exchange process by directing incoming wind airflow in the vertical direction, thereby providing required coolant air to the plurality of axial fans 420, which blow the air past the heat exchangers 412 above. At high wind conditions, the deflector devices 402 eliminate the stagnation zone at the fan inlet near the bottom portion of shroud 422, thereby reducing the static pressure at the fan inlet and increasing the available airflow to the fan.

EXAMPLE

A series of simulations were run to determine the percentage increase in airflow available to an axial fan having the exemplary deflectors described herein. The simulations including a deflector were compared to a first baseline simulation (Simulation No. 1 in Table 1 Below) with no airflow (i.e., no wind) and no modifications to the axial fan intake. Next, a simulation was run with wind at an airflow velocity of 6.5 m/s and no modifications to the axial fan intake (Simulation No. 2 in Table 1 below). Then, in Simulation Nos. 3-12 in Table 1 below, a deflector was placed adjacent to the axial fan intake and the percentage increase in airflow was measured.

TABLE 1

Fan Air Flow Change (%)

| Simulation No. | Air Mitigation Configuration | % Change |
|---|---|---|
| 1 | No Modifications w/no wind (Ref Case) | — |
| 2 | No modifications (open) | −32% |
| 3 | Scoop (D = 7 m, L = 8 m, θ = 0°) | −17% |
| 4 | Scoop (D = 7 m, L = 8 m, θ = 30°, bot) | −15% |
| 5 | Scoop (D = 9 m, L = 8 m, θ = 30°, bot) | −11% |
| 6 | Scoop (D = 9 m, L = 9.5 m, θ = 30°, flat bot) | −9% |
| 7 | Scoop (D = 9 m, L = 9.5 m, θ = 30°, bot −20°) | −7% |
| 8 | Elbow (D = 5 m, no flare) | −16% |
| 9 | Elbow (D = 7 m) | −3% |
| 10 | Elbow (D = 7 m) w/3 vanes | 0% |
| 11 | Elbow (D = 9 m) | 2% |
| 12 | Elbow (D = 9 m) w/3 vanes | 13% |

For Simulation Nos. 3-7, a scoop deflector similar to deflector 202 described above was placed adjacent to the axial fan intake. The scoop deflector in simulation No. 3 had an outlet diameter of 7 m and a straight (i.e., not angled) back wall having a length of 8 m. The scoop deflector in Simulation No. 4 had an outlet diameter of 7 m, an angled back wall (i.e., 30 degrees with respect to a vertical Y-axis or 60 degrees with respect to a horizontal X-axis) having a length of 8 m, and a bottom wall extending perpendicular to the back wall. The scoop deflector in Simulation No. 5 was identical to that of Simulation No. 4, with the exception of having an outlet diameter of 9 m. The scoop deflector in Simulation No. 6 had an outlet diameter of 9 m, an angled back wall (i.e., 30 degrees with respect to a vertical Y-axis or 60 degrees with respect to a horizontal X-axis) having a length of 9.5 m, and a bottom wall extending along a horizontal axis. The scoop deflector in Simulation No. 7 was identical to that of Simulation No. 6, with the exception of having a bottom wall with an axis extending at an angle of −20 degrees with respect to a horizontal X-axis.

For Simulation Nos. 8-12, an elbow deflector similar to deflector 102 described above was placed adjacent to the axial fan intake. The elbow deflector in Simulation No. 8 had an inlet and outlet diameter of 5 m. The elbow deflector in Simulation No. 9 had an inlet and outlet diameter of 7 m. The elbow deflector in Simulation No. 10 had an inlet and outlet diameter of 7 m and also included three vanes disposed in the inner surface of the deflector. The elbow deflector in Simulation No. 11 had an inlet and outlet diameter of 5 9 m. The elbow deflector in Simulation No. 12 had an inlet and outlet diameter of 9 m and also included three vanes disposed in the inner surface of the deflector.

Figure 5:
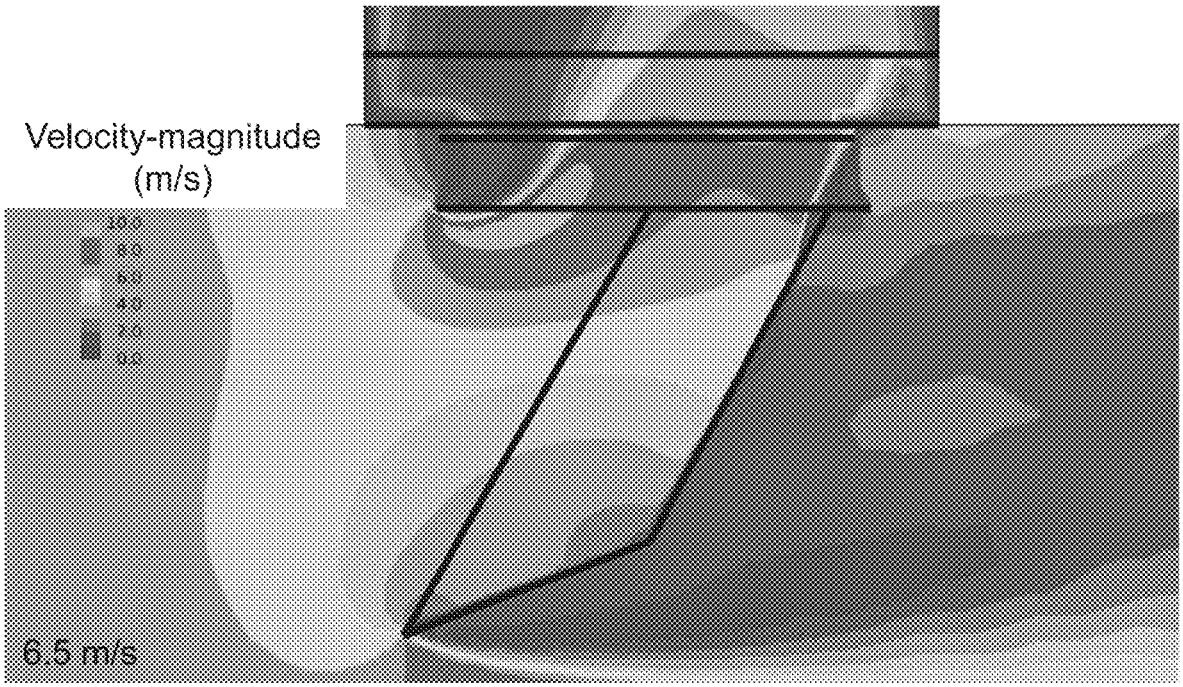
FIG. 5 is a computation fluid dynamics (CFD) plot showing the airflow percentage increase performance of a wind mitigation deflector device configured similarly to the device of FIG. 2.
Figure 6:
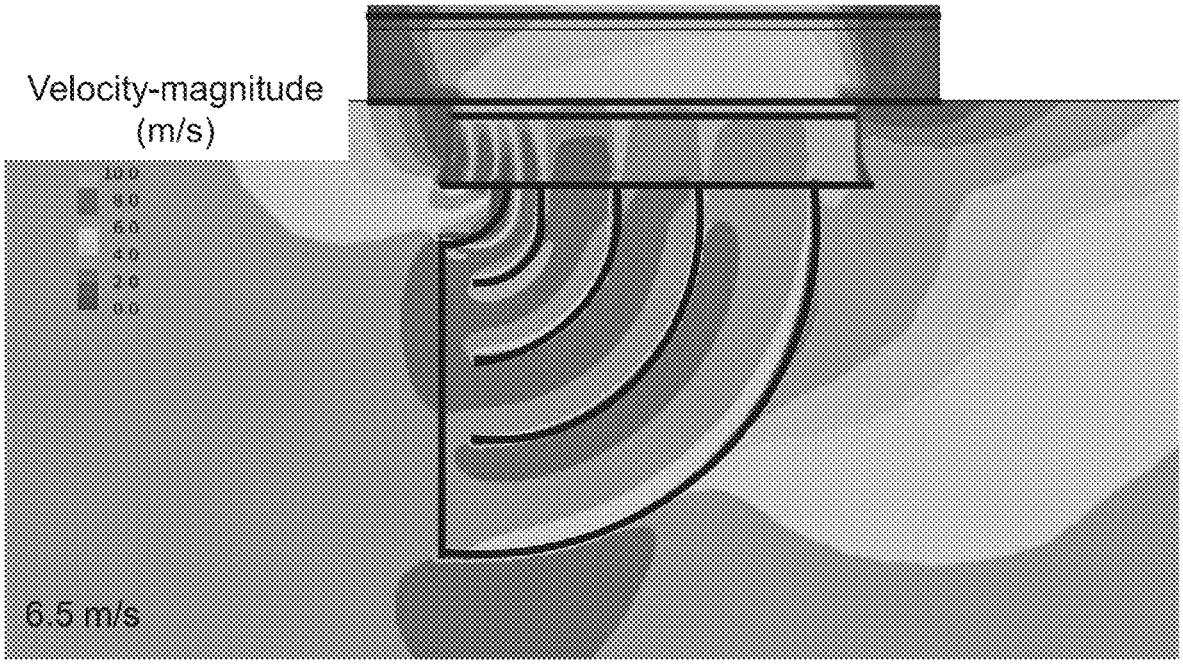
FIG. 6 is a computation fluid dynamics (CFD) plot showing the airflow percentage increase performance of a wind mitigation deflector device configured similarly to the device of FIG. 1.

As shown in Table 1 above, the scoop-type deflector which exhibited the greatest percentage change in available air flow to the axial fan inlet was the scoop deflector configuration in Simulation No. 7, which showed an airflow percent increase of 25 percent over the axial fan intake with no modifications. The elbow-type deflector which exhibited the greatest percentage change in available air flow to the axial fan inlet was the elbow deflector configuration in Simulation No. 12, which showed an airflow percent increase of 45 percent over the axial fan intake with no modifications. The results of Simulation No. 7 and Simulation No. 12 are shown in the CFD plots of FIGS. 5 and 6, respectively.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A wind mitigation device comprising, a deflector that includes an inlet and an outlet; and, an axial fan disposed above the outlet of the deflector and including a shroud, the shroud of the axial fan and the outlet of the deflector being aligned along a common vertical axis;

wherein the deflector is adapted to receive an airflow at the inlet and direct the airflow through the outlet in a vertical direction toward the axial fan, wherein the deflector inlet is aligned along an axis different from the axis of the shroud and the deflector outlet, and wherein the deflector inlet and the deflector outlet have identical diameters.

2. The wind mitigation device of claim 1, wherein the outlet of the deflector is positioned adjacent to a bottom portion of the shroud.

3. The wind mitigation device of claim 1, wherein the deflector is an elbow shape such that the deflector inlet is substantially aligned along a horizontal axis perpendicular to the common vertical axis of the shroud and the deflector outlet.

4. The wind mitigation device of claim 3, wherein the deflector further comprises an inner surface including one or more vanes positioned along the inner surface.

5. The wind mitigation device of claim 4, wherein the deflector has three vanes positioned along the inner surface of the deflector.

6. The wind mitigation device of claim 1, wherein the diameter of the deflector inlet and deflector outlet is from 3 m to 10 m.

7. The wind mitigation device of claim 1, wherein the shroud has a diameter greater than a diameter of the deflector outlet.

8. The wind mitigation device of claim 1, wherein the deflector further comprises a scoop section connected to a vertical pipe section, the inlet of the deflector being located at an open front wall of the scoop section and the outlet of the deflector being located on the vertical pipe section.

9. The wind mitigation device of claim 8, wherein the scoop section comprises a bottom wall and a back wall configured to direct the airflow into the vertical pipe section.

10. The wind mitigation device of claim 9, wherein the bottom wall is substantially aligned with a horizontal axis and the back wall extends at an angle of about 45 degrees to about 75 degrees with respect to the horizontal axis, including about 60 degrees.

11. The wind mitigation device of claim 10, wherein the bottom wall is aligned with an axis extending at an angle of about −5 degrees to about −35 degrees with respect to the horizontal axis, including about −20 degrees.

12. The wind mitigation device of claim 8, wherein the back wall has a length of about 5 m to about 10 m.

13. The wind mitigation device of claim 1, further comprising one or more powered rollers configured to rotate the deflector such that the deflector inlet is aligned with a direction of the airflow.

14. The wind mitigation device of claim 13, wherein the plurality of deflectors are arranged along an outer perimeter of the array.

15. The wind mitigation device of claim 1, further comprising a plurality of deflectors arranged in an array and a plurality of axial fans and shrouds disposed above the plurality of deflectors.

16. An air-cooled condensing system including the wind mitigation device of claim 1.

17. The wind mitigation device of claim 1, wherein the deflector is adapted to increase the airflow available at the axial fan by 16% to 45%.

18. An air-cooled condensing system comprising:

a plurality of deflectors each including an inlet and an outlet;

a plurality of axial fans disposed above the outlets of the deflectors and each including a shroud, the shrouds of the axial fans and the outlets of the deflectors each being aligned along a common vertical axis, the deflectors each configured to receive an airflow at the inlets and direct the airflow through the outlets in a vertical direction toward the axial fans;

a platform supporting the axial fans and shrouds and optionally supporting the plurality of deflectors;

a heat exchanger disposed above the platform to receive the airflow from the axial fans, wherein the inlet of each deflector is aligned along an axis different from the axis of the shroud and the deflector outlet, and wherein the inlet and outlet of each deflector have identical diameters.

19. A wind mitigation device comprising, a deflector that includes an inlet and an outlet; and, an axial fan disposed above the outlet of the deflector and including a shroud, the shroud of the axial fan and the outlet of the deflector being aligned along a common vertical axis;

wherein the deflector is adapted to receive an airflow at the inlet and direct the airflow through the outlet in a vertical direction toward the axial fan; and wherein the deflector is an elbow shape such that the deflector inlet is substantially aligned along a horizontal axis perpendicular to the common vertical axis of the shroud and the deflector outlet;

wherein the deflector inlet and the deflector outlet have identical diameters.

* * * * *